United States Patent [19]

Perkins

[11] 3,968,891

[45] July 13, 1976

[54] UNITIZED TWO STAGE COMPACTOR APPARATUS FOR REFUSE COLLECTING TRUCKS OR THE LIKE

[75] Inventor: William V. Perkins, Monrovia, Calif.

[73] Assignee: Maxon Industries, Inc., Huntington Park, Calif.

[22] Filed: Jan. 16, 1975

[21] Appl. No.: 541,614

[52] U.S. Cl. ..... 214/83.3; 100/142; 100/215

[51] Int. Cl.[2] ..... B65F 3/00

[58] Field of Search ..... 214/83.3, 518, 503; 100/137, 141, 142, 215, 190

[56] References Cited

UNITED STATES PATENTS

| | | | |
|---|---|---|---|
| 2,961,105 | 11/1960 | Shubin | 214/83.3 |
| 3,211,309 | 10/1965 | Shubin | 214/83.3 |
| 3,371,599 | 3/1968 | Tezuka | 100/215 |
| 3,890,889 | 6/1975 | Fishburne | 214/83.3 X |

*Primary Examiner*—Albert J. Makay
*Attorney, Agent, or Firm*—Frederick E. Mueller

[57] ABSTRACT

A trash hopper comprises part of a unitary structure including a housing that is formed, in part, by a swingable pre-compactor panel that in a retracted position slopes downwardly and rearwardly to gravitationally feed refuse toward the collection bin. Along a horizontal lower edge this panel is mounted for pivotal movement about an axis located in substantially the same vertical plane as the rear face of a reciprocable primary compaction ram which acts as a piston to force trash in the collection bin rearwardly through an open rear end of the hopper and to compact trash in the collection tank of a dump vehicle or other container. In the retracted position the pivotally mounted panel serves as a protective enclosure for its own actuating means and for the retracted ram and its hydraulic actuating cylinder or cylinders. On occasions when the hopper is overfilled, particularly with relatively low density, highly compressible materials, the swingable panel is moved rearwardly and downwardly to precompact the refuse and, by virtually closing the upwardly facing opening of the hopper defines an essentially closed conduit through which the primary compacting ram may reciprocate.

9 Claims, 6 Drawing Figures

14
16
17
67
13
15
11
20
10
12

28
55
61
60
48
54
49
40
47
52
41
50
38
46
45
26
51
18
53
39
17
19
37
35
36
31
41
33
32
34
21
29
16

Fig. 3
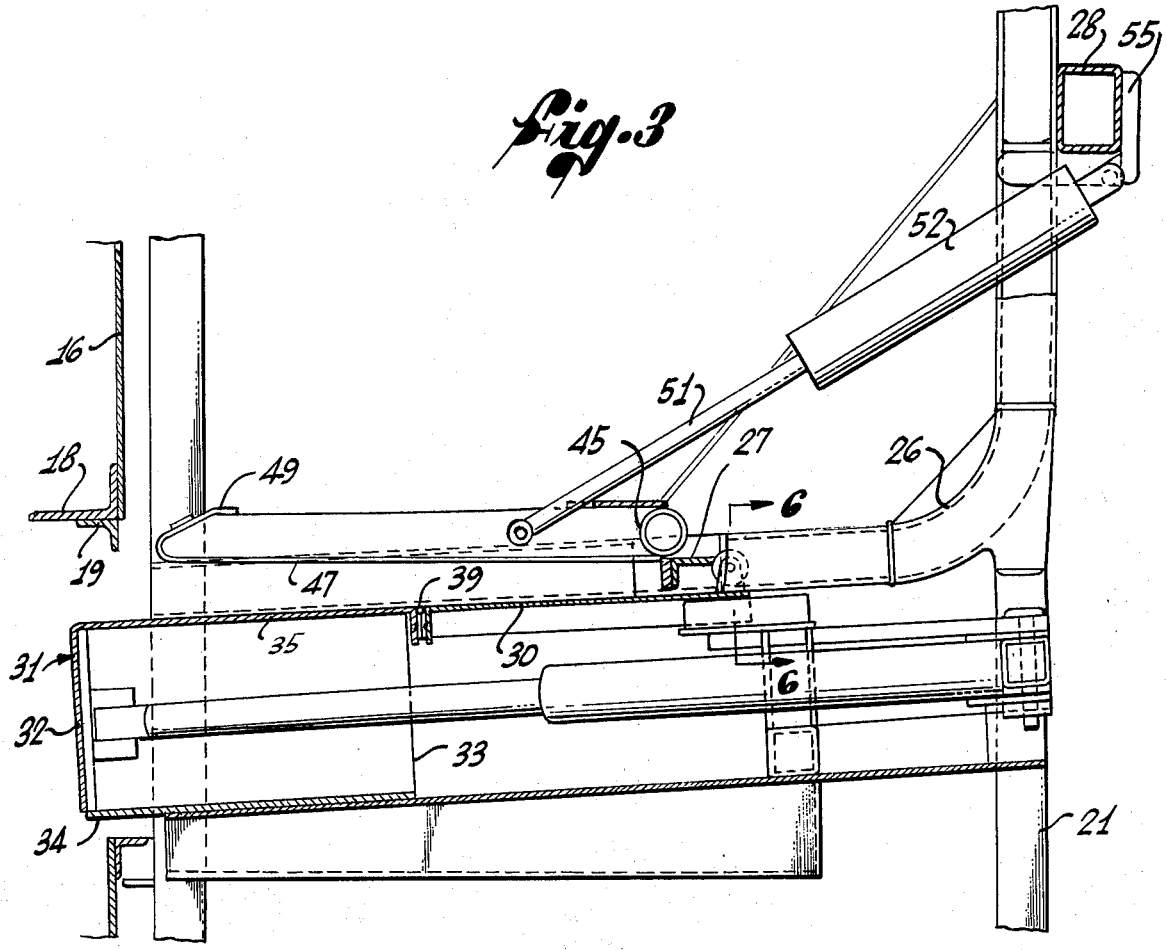
Fig. 4
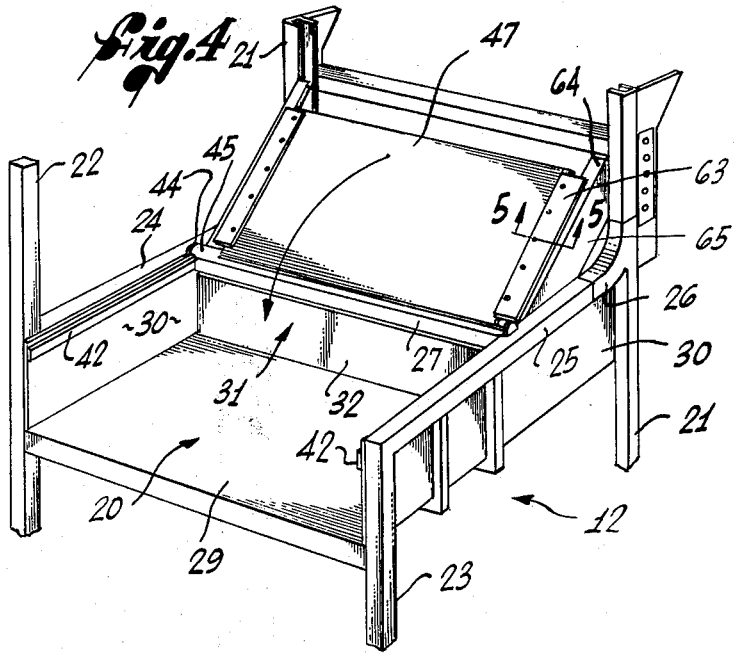
Fig. 5
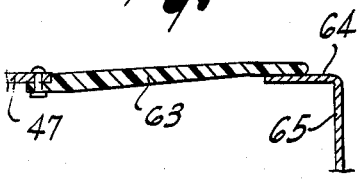
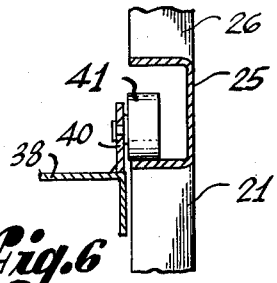
Fig. 6

UNITIZED TWO STAGE COMPACTOR APPARATUS FOR REFUSE COLLECTING TRUCKS OR THE LIKE

BACKGROUND OF THE INVENTION

The present invention relates to refuse compacting apparatus and particularly to such apparatus as primarily adapted for use in refuse collection trucks.

Refuse collection vehicles of the type having a trash collection bin and compacting mechanism positioned between the cab of the vehicle and the collection tank are well known. One example is disclosed in Shubin U.S. Pat. No. 2,961,105. In such devices, the trash is picked up at curbside and dumped into a hopper behind a normally retracted compaction ram which, when actuated, thrusts the refuse rearwardly into an opening formed in the forward wall of a dump container body or tank. On some occasions, the hopper may be filled to overflowing, whereupon it is desirable to precompact the trash downwardly prior to thrusting it rearwardly with the primary compactor ram. In the aforementioned patent, this is accomplished by means of a large vertically extending framework supporting a horizontally disposed and vertically rerciprocable platen which descends to the upper edge of the hopper to form a fully closed rigid conduit through which the primary compactor ram is actuated. The mechanism of this aforementioned patent is relatively complex and expensive, and further, because of the disclosed structure, involves a complex safety mechanism involving opposite side raisable and lowerable gates which must be actuated prior to lowering of the precompacting platen.

An improved refuse collecting vehicle is shown in Shubin U.S. Pat. No. 3,211,309. In this latter example, the apparatus is improved in that a unitary refuse receiving hopper and compactor mechanism are shown without, however, incorporating the feature of a precompactor element. Accordingly, in order to improve the operation of the later device, a crusher panel has been employed of substantially rectangular planform having a lower transverse edge pivotally connected immediately above the upper edge of the refuse receiving opening to the forward wall of the collection tank. This crusher panel was then moved between an extended position overlying the hopper and a retracted position in substantially flush engagement with the forward wall of the tank by a hydraulic cylinder. Accordingly, a truly unitary two stage compactor apparatus was not achieved and, in addition, the arrangement has been disadvantageous in necessitating the running of the hydraulic lines rearwardly around the pivotal axis for dumping the refuse tank and thence forwardly along the chassis to the source of the hydraulic power. Such an arrangement is relatively costly, not only in terms of the materials employed and the excessive wear induced as a result of raising and lowering of the dump body, but has also increased the weight required to be raised and lowered by the dump cylinders.

SUMMARY OF THE INVENTION

The present invention provides an extremely compact fully unitized two-stage compactor apparatus which appears to have its greatest utility when employed in connection with refuse collection vehicles of the type having a dump tank. A unitary assembly includes a framework which is mountable on the chassis of the refuse collecting vehicle intermediate the collection tank and the driver's compartment. This framework includes an upwardly open hopper whose rear end is also open and is aligned in proximal registration with a horizontally elongate opening in the front bulkhead of the vehicle tank. The primary compactor ram is mounted within the hopper for reciprocation, having a retracted position in which refuse can be dumped into the hopper rearwardly of the ram. A housing for the retracted primary ram is formed, in part, by a swingable precompactor panel, preferably pivotally mounted along its horizontally lower edge for movement about an axis located in substantially the same vertical plane as the rear face of the retracted ram. The panel in retracted position slopes forwardly and upwardly from its hinge axis to normally cover its own actuating means as well as the components of the retracted primary ram and its actuating means and, as so retracted, gravitationally deflects refuse forwardly and downwardly onto the hopper. When the hopper is overfilled, the precompactor panel is actuated to swing rearwardly and downwardly to substantially a horizontally disposed fully extended position, effecting a precompaction of the refuse which can then be driven into the reception tank to be compacted therein by the primary ram. The main portion of the panel comprises a rigid sheet member which along its opposite side edges is provided with flexible flaps. The surrounding framework for the panel, in both the fully extended and fully retracted positions, defines gaps relative to the opposite side edges of the main panel, which gaps are bridged by the flexible flaps. Accordingly, no pinch points or shear lines are present and the possibility of injury to the operator is avoided. For purposes of maintenance and inspection, the precompactor panel is movable to the fully extended position exposing the primary compactor mechanism, which may be inspected in both the fully extended and fully retracted positions.

BRIEF DESCRIPTION OF THE DRAWINGS

FIG. 3 is a longitudinal sectional view, similar to FIG. 2, but illustrating the parts in different relative positions during another phase of operation.

FIG. 4 is a perspective view of the unitized two stage compactor apparatus of this invention.

FIG. 5 is a sectional view on the line 5—5 of FIG. 4.

FIG. 6 is a sectional view on the line 6—6 of FIG. 3.

DESCRIPTION OF THE PREFERRED EMBODIMENT

Figure 1:
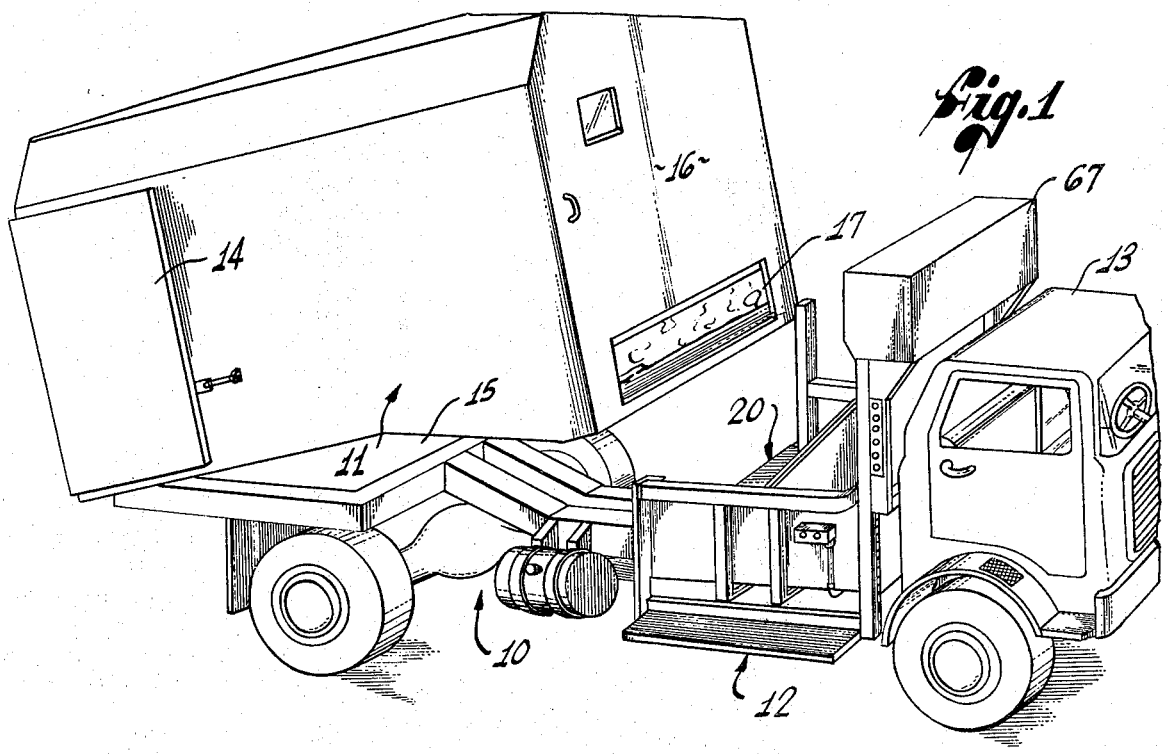
FIG. 1 is a perspective view of a refuse collecting and compacting truck embodying the invention, the container tank being depicted in a partially elevated position to dump the contents thereof.

Referring to FIG. 1, a conventional truck chassis 10 mounts a refuse receiving tank 11, a unitized hopper and compactor section 12, and a cab 13. As is indicated by the partially elevated position of the tank 11, it is conventionally pivotally supported by a hinge means (not shown) having an axis extending transversely of the rear end of the chassis. While not illustrated, it will be understood that the truck is provided with any suitable conventional means for raising and lowering the tank 11 in order to gravitationally discharge the trash from the tank when normally closed doors 14 at the rear end of the tank have been opened.

Figure 2:
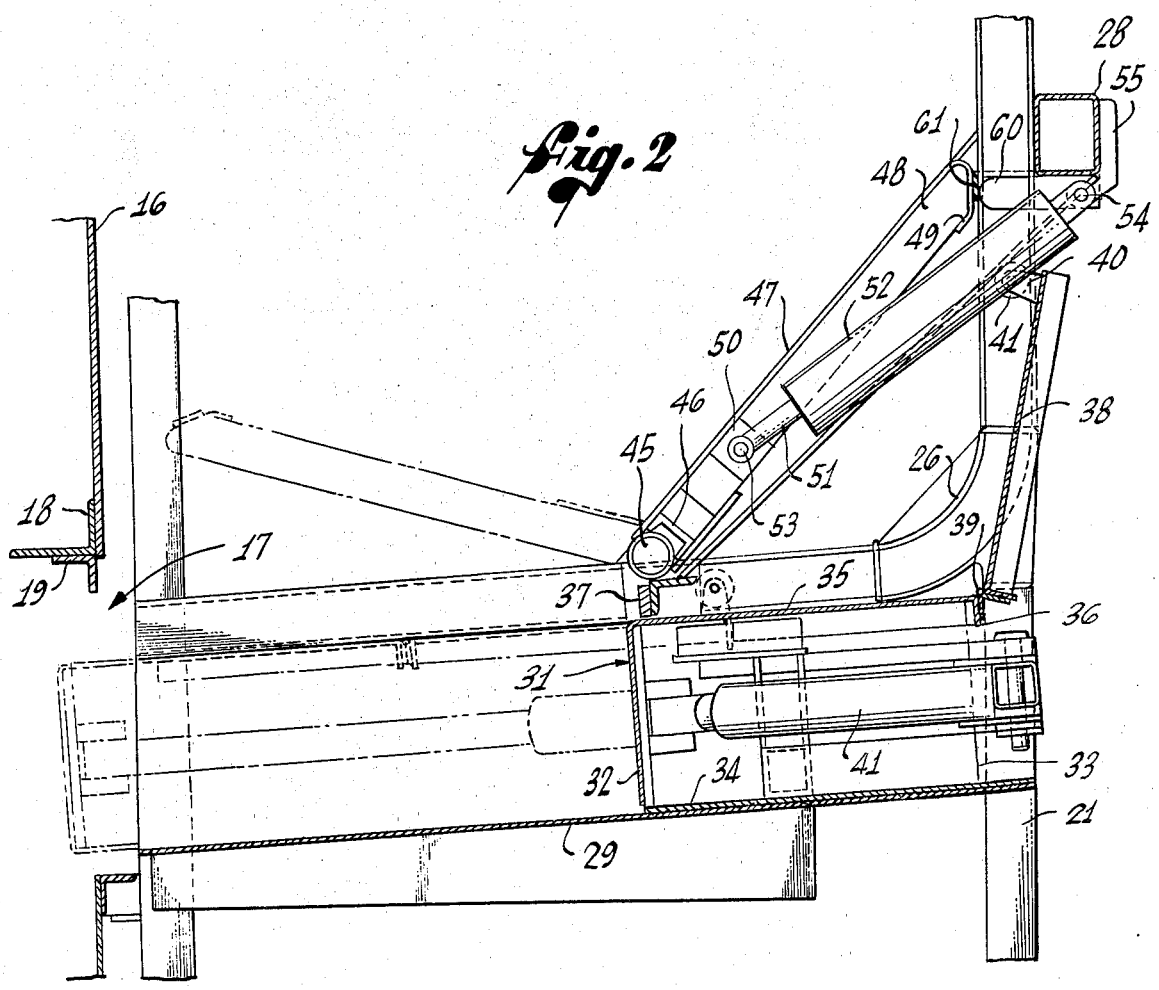
FIG. 2 is a longitudinal section, on an enlarged scale, through the trash loading and compacting bin section of the vehicle.

The tank 11 may be of a configuration such as that disclosed in U.S. Pat. No. 2,961,105, in that the forward portion of its floor comprises a forwardly and downwardly sloping portion, as indicated at 15, and includes a planar forward bulkhead 16 that is formed at its lower end with a horizontally elongate, rectangular refuse receiving opening 17. As is indicated in FIG. 2, the opening 17 may be framed by angle iron members 18 and the upper margin of the opening 17 is fitted throughout its length with a breaker bar 19, which may also be of right angular cross-sectional configuration. It will be understood that when the tank 11 is in the fully lowered position and directly supported on the drop-frame of the chassis 10, the refuse receiving opening 17 is positioned in registration with the outlet end of the hopper 20 of the unitary assembly 12.

As is indicated in FIG. 4, the unitary loading and compactor section 12 may be made up of conventional metal framing channels and sheet. Thus, a pair of front posts 21 and a pair of rear posts 22 and 23 are rigidly interconnected by opposite side rail members 24 and 25 whose forward ends are joined to the front posts 21 by means of arcuately bent channel sections 26. In the central region of the framework, the opposite side rails 24 and 25 are rigidly interconnected by a transverse angle beam 27 and the framework may be further rigidified by means of a transverse box beam 28 interconnecting the front posts 21 adjacent their upper ends. Within this framework there is secured, as by means of welding, a sheet metal floor panel 29 extending the full length of the framework and bounded at opposite sides by sheet metal side panels 30, also longitudinally co-extensive with the supporting framework, all defining the hopper 20.

The primary trash compaction ram and the operating means, generally designated at 31, may be of the type disclosed in Shubin U.S. Pat. No. 3,211,309. In brief, the ram comprises a hydraulically powered, generally box-like piston that is slidably supported for reciprocation on the floor panel 29 and between the opposite side walls 30.

The compacting face of the piston comprises a rectangular substantially vertically disposed plate 32 defining the closed end of the box-like structure. At each of the opposite vertical edges, the plate 32 has forwardly extending side plates 33 secured thereto whose outwardly facing surfaces slidably engage the opposed inwardly facing surfaces of the hopper side walls 30. In similar fashion, a bottom plate 34 of the piston structure is slidably supported on the upper surface of the bin floor 29. A top plate 35 is secured to the upper edge of the compactor plate 32 to extend forwardly therefrom to terminate at its forward end in a downwardly directed flange 36. The upper surface of the top plate 35 is spaced slightly from the lower edge of a vertically disposed flange of the transverse brace member 27, the latter having a wiper gasket 37 secured to the rearwardly facing surface thereof for wiping contact with the upper surface of the piston structure.

The member 35 comprises a fixed leaf of the piston top, the balance of the top comprising a rectangular sheet 38 whose rear edge is hingedly interconnected to the forward edge of the member 35 by hinge means 39. At its forward edge, the movable leaf 38 is fitted along opposite edges with a pair of brackets 40 each of which mounts a roller 41 rolling engageable with internal surfaces of one of the side rails 24, arcuate channel sectors 26, and portions of the vertically disposed forward posts 21. As will be apparent, from an examination of FIGS. 2 and 3, when the compactor piston moves from the retracted position of FIG. 2 to the fully extended position of FIG. 3, the swingable leaf 38 turns from the generally vertically disposed position of FIG. 2 into the generally horizontally disposed position of FIG. 3, in which it is substantially co-planar with the fixed leaf 35. Extension and retraction of the compactor piston is effected by means of a pair of angularly related hydraulic cylinders 52, each having its piston rod secured to the central interior of the compactor face 32 and each having the cylinder housing pivotally connected at its forward end to one of the opposite sides of the supporting framework.

As will be apparent, when the compactor piston is in the retracted position of FIG. 2, refuse may be deposited into the hopper 20 behind the compactor face 32 to be forced through the opening 17 into the tank 11 upon actuation of the hydraulic cylinders 52. As trash is compacted within the tank, considerable back pressures may be exerted on the compacting face 32 and, accordingly, in order to prevent any upward deflection of the compactor piston, the opposite side walls 30 of the hopper are fitted along their inner faces and along their upper edges with hold-down guide members 42, constraining the piston to purely rectilinear movement within the hopper.

A pair of coaxially aligned bearings 44 are affixed to the side rails 24 and 25 immediately above the transversely extending frame member 27 to pivotally journal opposite ends of a pivot rod 45. As is shown in FIG. 2, a channel 49 is secured along one side of the pivot rod 45 to define one side of a framework for a rectangular panel 47 that is swingable between a retracted position, indicated in FIG. 2, and a fully extended position, illustrated in FIG. 3. The supporting and rigidifying framework for the panel 47 includes a pair of opposite side members 48 rigidly secured, as by welding, to opposite vertical edges of the panel 47. At its free, swingable end, the sheet material of the panel 47 is reversely bent, as indicated at 49, to wrap around the swingable ends of the side frame members 48.

A bracket 50 is secured to the inside surface of the panel 47 to have one end of a rod 51 of a hydraulic cylinder 52 pivotally secured thereto, as indicated at 53, the other end of the cylinder 52 being pivotally connected, as indicated at 54, to a bracket 55 anchored on the transverse box beam 28. In the illustrated case, in which but a single cylinder is employed for actuation of the panel 47, the thrust axis of the cylinder is preferably aligned in the same vertical plane as the central longitudinal axis of the hopper. However, as will be apparent, if a plurality of cylinders are to be employed, they may be otherwise oriented, for example, in a fashion similar to the orientation of a pair of cylinders 41.

The shorter fore and aft dimension of the rectangular panel 47 is such that when it is in the fully extended, horizontal position in FIG. 3, the hopper is covered thereby. At the same time a clearance is maintained between the now rearwardly directed flange 49 of the panel and the forward bulkhead 16 of the tank in order to avoid any possibility of shearing or pinching action should the operator's hand, for example, become caught therebetween.

Referring to FIG. 2, it will be observed that the transverse box beam 28 is mounted on the forward faces of the pair of front posts 21 and has a pair of stop members 60 secured to the underside thereof projecting rearwardly to terminate substantially in the plane of the rear faces of the front posts 21. The pair of stops, one being shown in FIG. 2, are laterally spaced apart, preferably in alignment with the opposite side frame members 48 for the panel 47, at which pair of points the reversely bent flange 49 of the panel 47 is fitted with a pair of bumper pads 61 engagable with the rear end faces of the stop members 60. Accordingly, except for the stop engagement between the pads 61 and the stops 60, an appreciable gap is provided between the swingable edge of the panel 47 and the beam 28 to minimize the possibility of injury to an operator's hand upon retraction of the panel 47.

In its long dimension, extending transversely of the mechanism, the panel 47 is shorter than the space defined between the hopper side walls 30, preferably sufficiently shorter to provide a gap on the order of 4 to 5 inches between the opposite side edges of the panel and the side walls 30. Each of the opposite side edges of the panel 47 is fitted throughout its length with a flexible flap 63 defining a substantially flush sideward extension of the panel 47 and an overall long dimension of the panel assembly substantially the same as the transverse distance between the side walls 30. With this arrangement, dangerous shear lines or pinch points are eliminated in both the fully extended and fully retracted positions of the panel 47. In the fully retracted position of the panel 47, its edge flaps 63 come into abutment with a flange 64 of a side wall panel 65, the inner edge of the flange 64 being spaced on the order of 4 to 5 inches from the corresponding edge of the panel 47. As is shown in FIG. 4, each of the side panels 65 defines a side closure above the corresponding side rail 24 or 25 with its flange 64 defining an upper end of the closure panel oriented within the plane occupied by the retracted panel 47.

If desired, the hydraulic cylinders 41 for the compaction ram and the hydraulic cylinder 52 for actuating the panel 47 may both be operated or driven by a power take off from the engine of the vehicle 10. Alternatively, as is indicated in FIG. 1, the unitary assembly 12 may be fitted at the upper end of the forward posts 21 with an auxiliary hydraulic drive engine or engines mounted within a suitable housing 67. In any event, the primary compaction ram cylinders 41 and the cylinder 52 for the panel 47 are provided with separate, independent control systems so that each of the compacting devices is operable independently of the other.

In the use of the vehicle, the panel 47 normally occupies the retracted position shown in FIG. 2 in solid outline. So positioned, the panel provides a protective cover for the normally retracted primary packer ram and, as can be seen by reference to FIG. 3, for the hydraulic components of the primary packer ram. Assuming the primary packer ram to be in the retracted position, the retracted panel 47 also serves as a guide to gravitationally deflect trash deposited thereon downwardly into the hopper for subsequent injection through the opening 17 into the tank 11.

Many of the loads of trash dumped into the hopper will be of sufficiently small volume that they can be compacted into the tank 11 merely by a cycle of the primary packer. On other occasions, a single load or an accumulation of loads may be dumped into the hopper of sufficient volume to extend above the upper edges of the side rails 24 and 25. For example, a single load including bulky but low density items such as tree trimmings, wooden crates, and boxes or the like, may rise to a height which is a multiple of the depth of the hopper 20. Then, and particularly when the tank 11 is approaching a fully loaded condition, actuation of only the primary compactor may result in a bubbling up of the trash in the hopper rather than any substantial injection thereof into the tank 11.

Under such overflow conditions, the trash is first precompacted in the hopper by the panel 47. Thus, the hydraulic cylinder 52 is actuated to swing the panel from the retracted position to the fully extended horizontally disposed position shown in FIG. 3 or, depending upon the density of the materials, to an intermediate position such as in indicated in dotted outline in FIG. 2. In this connection, it will be understood that the hydraulic cylinder 52 is provided with a control system permitting any desired degree of extension of the panel 47. In any event, such extension of the panel 47 effects a precompaction of the trash and a thrusting of it towards the opening 17 in the front bulkhead 16 of the tank. While the panel 47 is held in the fully extended position, or substantially so, it defines a virtually fully enclosed conduit in cooperation with the hopper and, while so held, the primary compactor is energized to thrust the precompacted trash into the tank 11, such action resulting in further compaction of the charge of refuse.

Surprisingly, the presence of the pair of flexible flaps 63 on the rigid panel 47 does not materially detract from the ability of this assembly to define as essentially closed conduit with the hopper. In other words, there is no appreciable escape of the precompacted material out of the hopper when covered by the panel 47 and its flaps and during a cycle of the primary compactor. This is a result of the precompaction achieved by the movement of the panel 47, which effects an intertwining and interlocking of the various trash materials as they are precompacted by the swinging movement of the panel. The precompacted trash, in effect, forms a coherent mass which is substantially bodily movable by actuation of the primary compactor for injection into the tank 11.

When the tank 11 is fully loaded, the panel 47 can be effectively employed in cooperation with the hopper to serve as a door or barrier preventing escape of the compressed trash in the tank 11 outwardly through the opening 17 in the forward bulkhead 16, during transit of the vehicle to a dumping site. In other words, with or without trash being present in the hopper, the fully lowered panel 47 prevents any escape of trash during trasit.

At the dumping site, upon opening of the rear doors 14 of the tank 11, and prior to any elevation of the tank, some of the compacted refuse will immediately eject itself through the open rear door of the tank as a reaction to its compressed condition. Thereafter, prior to elevation of the tank, and while the panel 47 remains in the fully lowered condition, the primary compactor may be operated through one or more cycles to insure that the hopper is fully cleansed and to insure that any residual trash is injected into the tank 11. Thereafter, the panel 47 is moved to its fully retracted position, which condition is also the normal de-energized condition of the primary compactor, after which the tank 11 is elevated to gravitationally discharge all of its contents onto the dump site.

Almost invariably, particles of trash will penetrate behind the primary compactor where, if allowed to accumulate, they will damage components of the hydraulic power system and, particularly, the guide shoes for the packer piston. Accordingly, as a matter of daily routine such intruding particles must be cleaned out and the components of the primary compactor examined. With this invention, in order to accomplish such daily inspection and maintenance, all that is required is to extend the panel 47 fully, which provides access to the upper surfaces of the packer piston leaves and their roller track guide assemblies. While the panel 47 remains in the lowered condition, the primary compactor may be fully extended and arrested in the fully extended position, as in FIG. 3, affording access to the guide shoes and the interior of the piston-like packer ram which can be inspected and cleaned as necessary.

While the presently preferred embodiment of the invention has been disclosed in considerable detail, it will be understood that various modifications can be made without departing from the scope of the invention.

I claim:

1. A refuse collecting and compacting truck, comprising;

a chassis having a refuse receiving tank thereon, a forward bulkhead of said tank being formed with a refuse receiving opening adjacent the lower end of said bulkhead;

an upwardly open refuse hopper mounted on said chassis forwardly adjacent to said bulkhead, said hopper having a rearwardly facing open end in registration with said opening in said bulkhead;

a primary compactor ram mounted within said hopper for reciprocation between a retracted position in which refuse is receivable within said hopper rearwardly of said ram, and an extended position;

a precompactor panel transversely mounted on said hopper in forwardly spaced relationship relative to said bulkhead for movement between retracted and extended positions, said panel, when retracted, overlying said retracted ram and extending vertically forwardly and upwardly to define a barrier adapted to gravitationally deflect refuse into said upwardly open hopper and away from said retracted ram, said panel having an actuating means for moving said panel between retracted and extended positions, said actuating means being so oriented as to be overlain by said panel when said panel is in said retracted position, said panel being movable rearwardly and downwardly by said actuating means to said extended position to compact refuse, if any, protruding above said hopper downwardly into said hopper and rearwardly towards said opening of said bulkhead, said panel, when fully extended, covering said hopper to define an essentially closed conduit with said hopper for reciprocation of said compacting ram and, also, then serving as a barrier against escape of refuse from said tank and said hopper.

2. A refuse collecting and compacting truck as in claim 1 in which said panel and said hopper are substantially rectangular in planform.

3. A refuse collecting and compacting truck as in claim 1 in which said retracted panel extends forwardly and upwardly from said hopper to overlie said retracted position of said ram.

4. A refuse collecting and compacting truck as in claim 3 in which said panel has an actuating means connected to that side thereof opposite to said opening of said bulkhead, said actuating means being protectively overlain by said panel when said panel is in said retracted position.

5. A refuse collecting and compacting truck as in claim 4 in which said primary compactor ram is operable independently of said panel and is arrestable in both retracted and extended positions while said panel is held in said extended position to permit the inspection of said ram in both arrested positions.

6. A refuse collecting and compacting truck as in claim 4 in which said panel is pivotally mounted for movement between said retracted and extended positions thereof about an axis that is included in a plane occupied by a rearward face of said ram when said ram is in said retracted position thereof.

7. A two stage refuse compactor comprising;

a rigid framework having an upwardly open hopper secured thereto, said hopper having a rearwardly facing open end for exhausting refuse into a receptacle to be positioned thereat;

a precompactor panel transversely mounted across said hopper for swingable movement between a forwardly and upwardly extending retracted position, in which said panel overlies the forward portion of the upwardly facing opening of said hopper, and a rearwardly directed fully extended position, in which said panel covers the upwardly facing opening of the rear portion of said hopper;

an actuating means interconnected between said framework and said panel for moving said panel between retracted and extended positions and so oriented as to be overlain by said panel when said panel is in said retracted position a primary compactor ram mounted within said hopper for reciprocation longitudinally thereof between extended and retracted positions, said ram having a rearwardly facing refuse engaging face and a top member extending horizontally across said hopper and forwardly from an upper edge of said ram face, said ram in retracted position being overlain by said panel when said panel is in said retracted position and being exposed when said panel is in said extended position;

and actuating means interconnected between said ram and said framework and disposed within said forward portion of said hopper to be at least partially exposed when both said panel and said ram are in said extended positions.

8. An apparatus as in claim 7 in which said panel and said hopper are of substantially rectangular planform and said panel is substantially horizontally disposed when in fully extended position with opposite side edges of said panel disposed in substantially contiguous relationship to opposite side upper edges of said hopper to define an essentially closed conduit with the rear section of said hopper to prevent upward deflection of trash forced rearwardly therethrough by said ram upon actuation of said ram.

9. An apparatus as in claim 8 in which said opposite side edges of said panel each mounts an outwardly, sidewardly extending flexible flap to bridge a gap between the corresponding panel edge and the corresponding upper side edge of said hopper, said framework including a frame opening in a plane corresponding to said retracted position of said panel to define a gap between each of said opposite side edges of said panel and the corresponding edge of said frame opening that is covered by the corresponding one of said flaps when said panel is in said retracted position.

* * * * *